US006538529B1

(12) United States Patent
Stenberg et al.

(10) Patent No.: US 6,538,529 B1
(45) Date of Patent: Mar. 25, 2003

(54) SIGNAL SEPARATOR AND BANDPASS FILTER

(75) Inventors: James T. Stenberg, Portland, ME (US); Sasha Long, Oxford, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/639,322

(22) Filed: Aug. 16, 2000

(51) Int. Cl.[7] ..... H01P 1/213; H01P 1/202
(52) U.S. Cl. ..... 333/134; 333/206
(58) Field of Search ..... 333/206, 207, 333/126, 127, 129, 132, 134

(56) References Cited

U.S. PATENT DOCUMENTS 3,602,848 A * 8/1971 Leonard ..... 333/206
4,245,198 A * 1/1981 Nishikawa et al. ..... 333/134
4,375,622 A * 3/1983 Hollingsworth et al. .... 333/126
4,473,807 A * 9/1984 Weber et al. ..... 333/206
5,774,193 A * 6/1998 Vaughan ..... 348/723

* cited by examiner

*Primary Examiner*—Robert Pascal
*Assistant Examiner*—Stephen E. Jones
(74) *Attorney, Agent, or Firm*—Baker & Hostetler LLP

(57) ABSTRACT

A signal separator and bandpass filter that use plates with posts. The signal separator uses two bandpass filters to separate two signals of different carrier frequencies from one another. The bandpass filters each have a transmission line with the metallic plates disposed along its length. The number of plates and the distances between adjacent plates determine the bandwidth and the rejection capability of the filter.

13 Claims, 3 Drawing Sheets

SIGNAL SEPARATOR AND BANDPASS FILTER

BACKGROUND OF THE INVENTION

1. Field of the Invention

This invention relates to a signal separator and a bandpass filter that are capable of handling high power radio frequency (rf) signal energy in television broadcast antenna installations.

2. Description of the Prior Art

The advent of digital television (DTV) has resulted in a need for a station to broadcast both a national television standard code (NTSC) signal for reception by NTSC sets and a DTV signal for reception by DTV sets. A common practice is to mount a DTV antenna to the existing tower upon which is mounted the NTSC antenna. A single transmission line extends up the tower for the purpose of feeding the NTSC signal from a transmitter to the NTSC antenna. Although the transmission line may be either a waveguide or a coaxial structure, a coaxial structure is preferred because of the additional wind loading on the tower and group delay distortion on the signal that results from a waveguide structure.

A separate transmission line could be added to feed the DTV signal up the tower to the DTV antenna. However, it is preferable to use the single existing transmission line to feed both the NTSC and the DTV signals to their respective antennas as this is less expensive and does not add wind load. For example, U.S. Pat. No. 5,774,193 uses a signal combiner to combine the NTSC and DTV signals to form a composite signal that is fed up the transmission line. A signal separator disposed at the upper end of the transmission line separates the composite signal into the DTV signal and NTSC signal for application to the DTV and NTSC antennas. The signal separator is formed of a high pass filter and a low pass filter. The high pass filter passes an ultra high frequency (UHF) DTV signal to the DTV antenna, but rejects a very high frequency (VHF) NTSC signal. The low pass filter passes the VHF NTSC signal to the NTSC antenna, but rejects the UHF DTV signal. The high and low pass filter separator may provide adequate bandwidth and rejection for the case of the DTV signal and the NTSC signal being in two different frequency bands. However, it does not provide adequate rejection for the case where the carrier frequencies of the two signals are relatively close together as, for example in the same frequency band.

Accordingly, there is a need for a signal separator that has adequate bandwidth and rejection for the case where the carrier frequency difference of signals to be separated is relative small. There is also a need for filter assemblies that can be used in such a separator.

SUMMARY OF THE INVENTION

The present invention satisfies the aforementioned needs with a signal separator that uses separate bandpass filters for each signal that is to be separated from a composite signal. Each bandpass filter is tuned to the carrier frequency of a different one of the signals. The filter assembly of the invention includes a coaxial transmission line having a hollow outer conductor and an inner conductor disposed within the outer conductor. One or more electrically conductive elements are disposed within the outer conductor and coupled mechanically and electrically to the outer conductor. In some preferred embodiments, each of the the electrically conductive elements is a plate that includes a metallic annulus and a metallic post that is diametrically disposed with respect to the annulus and that is coupled to the inner conductor. The number of plates and the distance between adjacent ones of the plates are determinative of the frequency of operation, bandwidth and rejection capability of the filter.

In one embodiment of the invention, the transmission line has a plurality of segments and one of the plates is disposed at an interface of adjacent ones of the segments. This embodiment takes advantage of flange connectors at the ends of each segment to form mechanical and electrical connection to one of the plates as well as to the outer conductors of adjacent segments.

Unlike a waveguide approach, the coaxial filter assemblies of the present invention are suitable for handling the pressurization of a coaxial line without changing the response of the separator. Also, the filter assemblies and separator are stable over a large temperature range that permit mounting the separator on the outside of the tower or other location that is exposed to ambient.

BRIEF DESCRIPTION OF THE DRAWING

Other and further objects, advantages and features of the present invention will be understood by reference to the following specification in conjunction with the accompanying drawings, in which like reference characters denote like elements of structure and.

DESCRIPTION OF THE INVENTION

The signal separator and/or filter assembly of the present invention can be used in any application that requires the separation of at least two signals of different frequency carriers from a composite signal. The signal separator and/or filter assembly of the present invention signal separator and/or filter assembly is especially useful in a broadcast antenna installation and will be described herein in that context.

Figure 1:
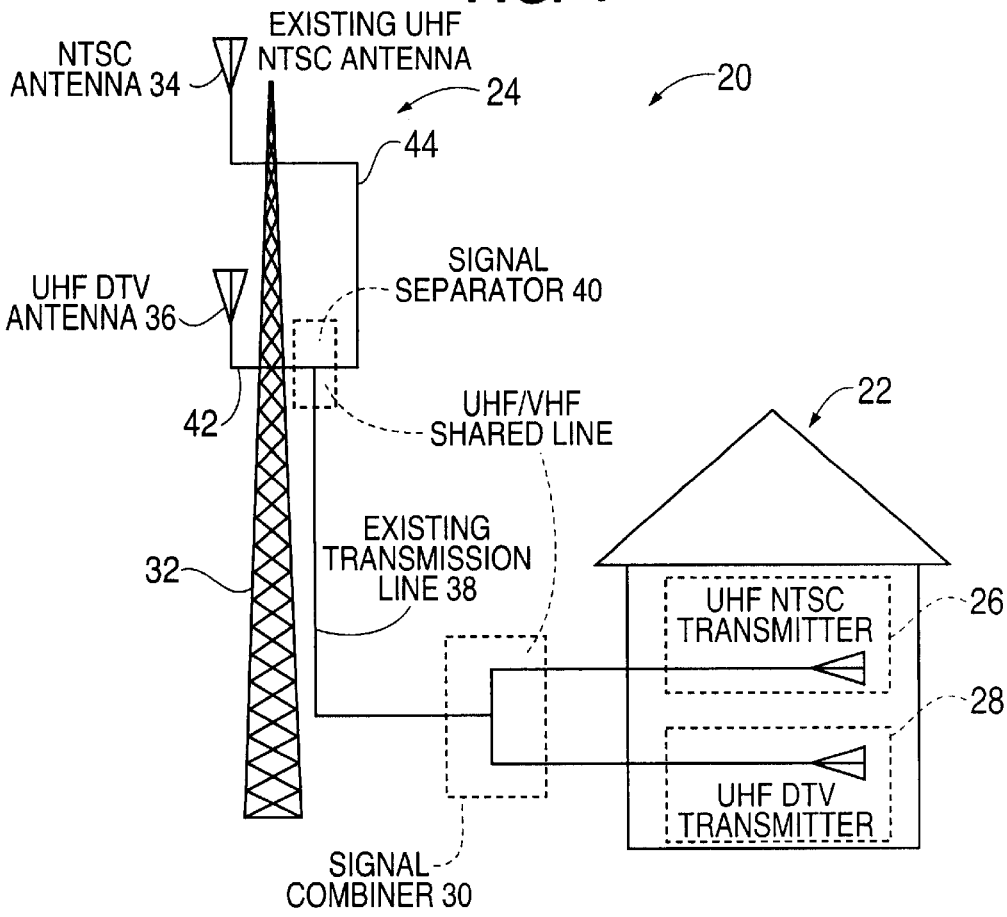
FIG. 1 is an elevation view of a television broadcast installation in which the signal separator of the present invention may be used.

Referring to FIG. 1, a broadcast installation 20 includes a power transmitter station 22 coupled to an antenna structure 24. Power transmitter station 22 includes an NTSC transmitter 26, a DTV transmitter 28 and a signal combiner 30. NTSC transmitter 26 provides an NTSC signal and DTV transmitter 28 provides a DTV signal. The NTSC and DTV signals are combined in signal combiner 30 to produce a composite signal.

Antenna structure 24 includes a tower 32, an NTSC antenna 34, a DTV antenna 36, a transmission line 38 and a signal separator 40. NTSC antenna 34, DTV antenna 36 and transmission line 38 are mounted to tower 32 by any suitable means (not shown). The composite signal output from signal combiner 30 is fed up transmission line 38 to signal separator 40. Signal separator 40 splits the composite signal into the NTSC signal and the DTV signal that are fed to NTSC antenna 34 and DTV antenna 36 via transmission line feeds 42 and 44, respectively.

Signal separator 40 comprises the present invention. The remainder of the aforementioned components of antenna structure 24 and all of the aforementioned components of power transmitter station 22 may be any suitable components, known currently or in the future, that provides the respective functions thereof.

Figure 2:
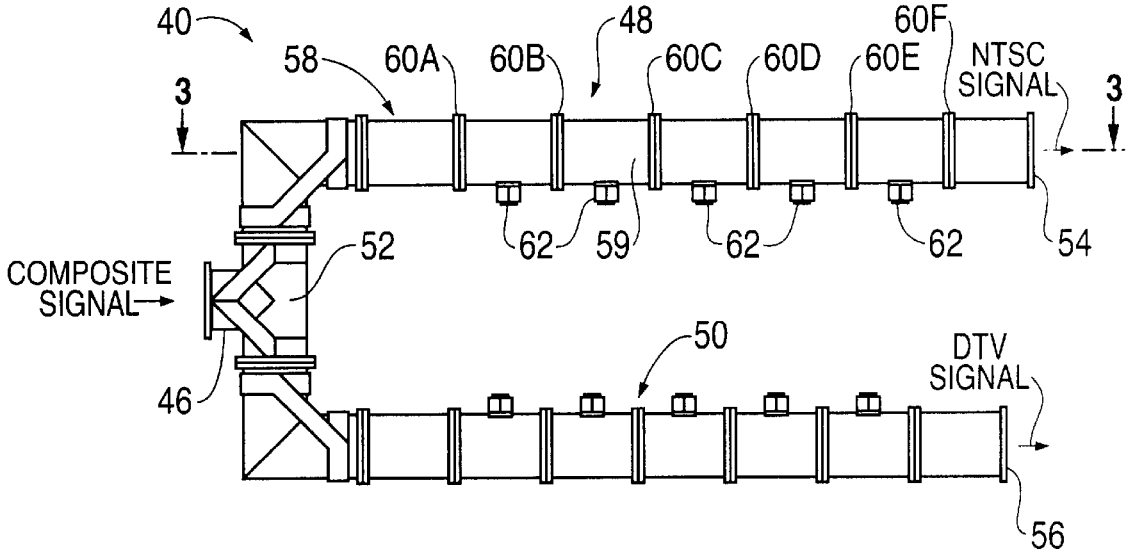
FIG. 2 is a plan view of a signal separator according to the present invention.

Referring to FIG. 2, signal separator 40 includes an input 46 joined to an NTSC signal bandpass filter 48 and a DTV band pass filter 50. A tee 52 joins input 46 to NTSC bandpass filter 48 and DTV bandpass filter 50. The composite signal from transmission line 38 is received at input 46 and filtered by NTSC bandpass filter 48 and DTV bandpass filter 50. NTSC bandpass filter 48 provides the NTSC signal at an output 54 and DTV bandpass filter 50 provides the DTV signal at an output 56. Although input 46, tee 52, NTSC bandpass filter 48 and DTV bandpass filter 50 can be implemented with waveguide or coaxial structures, or a combination thereof, they are shown herein as implemented with all coaxial structures.

As NTSC bandpass filter 48 and DTV bandpass filter 50 are substantially identical in structure, except for dimensions and number of filter sections to pass the respective NTSC and DTV carrier signals, only the NTSC bandpass filter 48 will be described in detail. NTSC bandpass filter 48 includes a transmission line 58 that has a plurality of electrically conductive coupling elements disposed along its length at spaced apart locations transversely to a longitudinal axis 59 thereof. Although the coupling elements may have any suitable geometry, they are shown as disks or plates 60A–60F for a preferred embodiment. Positioned intermediate plates 60A–60F are tuning assemblies 62.

Figure 3:
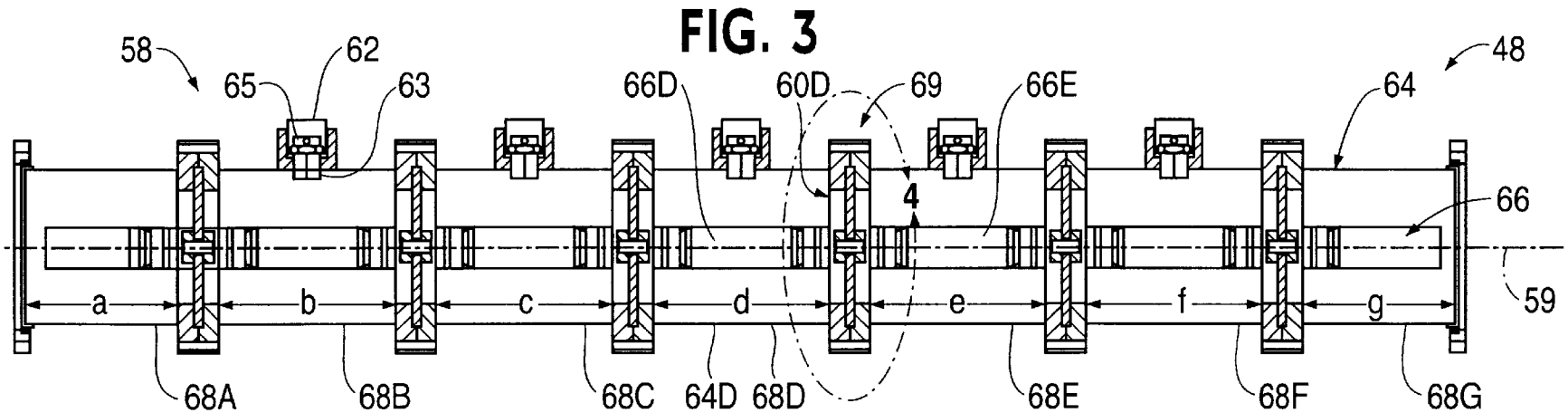
FIG. 3 is a cross-sectional view taken along the line 3—3 of FIG. 2.

Referring to FIG. 3, transmission line 58 has a hollow outer electrical conductor 64 and an inner electrical conductor 66. Although plates 60A–60F may be electrically and mechanically connected to outer conductor 64 by any suitable means, they are advantageously connected to outer conductor 64 by means of flanges that are used to connect adjacent segments of a segmented coaxial transmission line. To this end, coaxial transmission line 58 includes segments 68A–68G, each of which has a flange located on either end thereof. Plates 60A–60F are connected mechanically and electrically to inner conductors 60A–60F.

Figure 4:
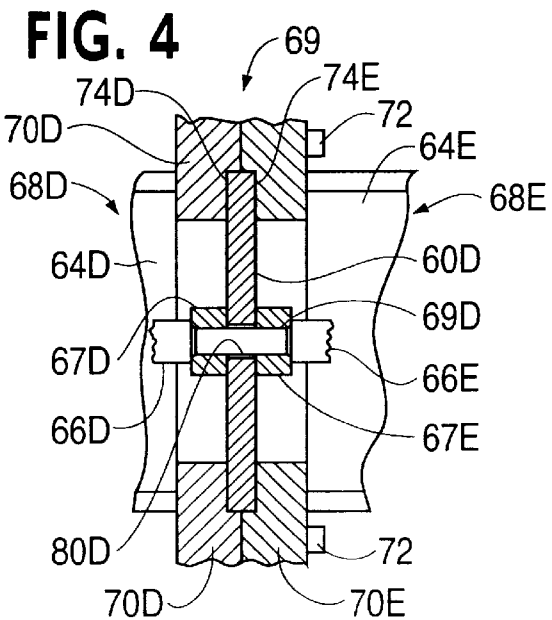
FIG. 4 is a cross-sectional view of a detail of FIG. 3.

Referring to FIG. 4, detail 69 of FIG. 3 shows portions of adjacent segments 68D and 68E as an example. Segment 68D has an outer conductor 64D and an inner conductor 66D. Segment 68E has an outer conductor 64E and an inner conductor 66E. Outer conductor 64D is fastened to a flange 70D and outer conductor 68E is fastened to a flange 70E by any suitable fastener, such as weldments, adhesives, screws, bolts and the like. Flanges 70D and 70E are fastened to one another, for example, by bolts 72. Flange 70D has a recess 74D and flange 70E has a recess 74E. Recesses 74D and 74E are shaped and dimensioned to press fit filter plate 60D therein. The press fit provides a mechanical connection and an electrical connection between outer conductors 64D and 64E, flanges 74D and 74 E and filter plate 60D.

Inner conductors 66D and 66E are connected mechanically and electrically to filter plate 60D by any suitable connector, known currently or in the future. For example, a connector 67D and a connector 67E are connected with the ends of inner conductors 66D and 66E, respectively. Connectors 67D and 67E are connected electrically and mechanically to a bullet or pin 69D that extends through and electrically engages a hub 80D of filter plate 60D.

Outer conductor 64 and inner conductor 66 are formed of any suitable electrically conducting metal, such as aluminum, copper, an alloy thereof and the like. Flanges 70D and 70E are formed of any suitable electrically conducting metal, such as aluminum, brass, and the like. Plates 60A–60F are formed of any suitable electrically conducting metal, such as aluminum, copper, an alloy thereof and the like.

Figure 5:
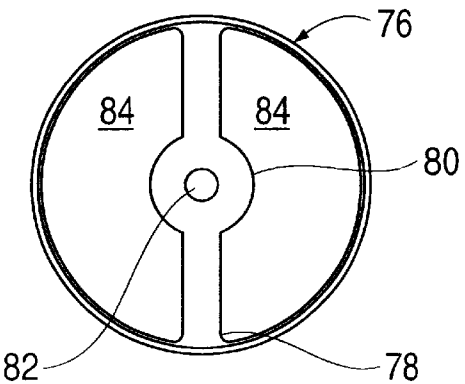
FIG. 5 is a front view of a post plate of the FIG. 2 signal separator.

Plates 60A–60F are substantially identical so that only filter plate 60D will be described in detail. Referring to FIG. 5, filter plate 60D has an annulus 76 and a post 78 that is diametrically located with respect to annulus 76. That is, post 78 extends radially inward from annulus 76. A hub 80 is formed in post 78. Post 78 can be considered as having two radially extending post elements 78A and 78B. Hub 80 has an aperture 82 to facilitate connections between inner conductors 66D and 66E (shown in FIG. 3) of segments 68D and 68E, respectively. Open regions 84 extend through annulus 76.

Figure 6:
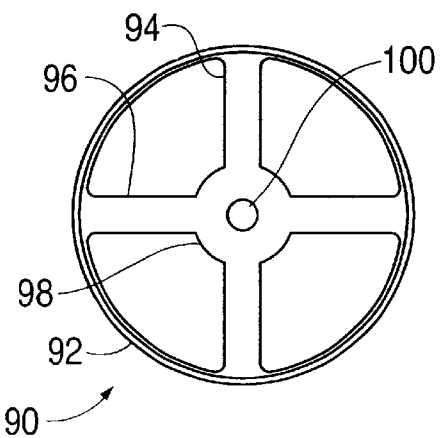
FIG. 6 is a front view of an alternate embodiment of the post plate.

Referring to FIG. 6, an alternate embodiment of filter plate 60 is shown as a filter plate 90. Filter plate 90 has an annulus 92 and a pair of posts 94 and 96 extending across annulus 92. A hub 98 is formed where posts 94 and 96 intersect. Hub 98 has an aperture 100 to facilitate connections between the inner conductors of adjacent segments of transmission line 58.

Figure 7:
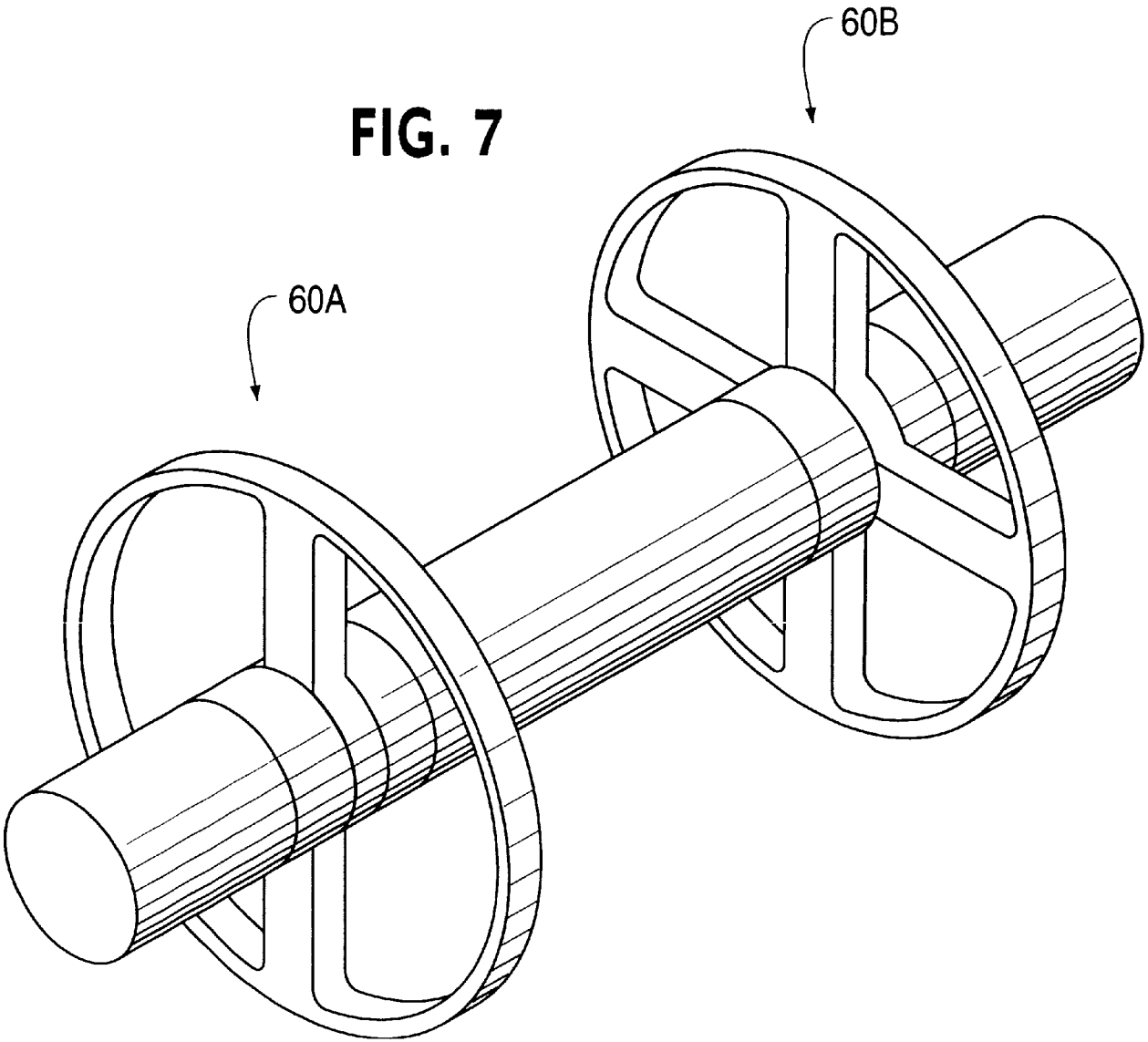
FIG. 7 is a perspective view of a portion of a bandpass filter of the present invention with different post configurations.

Although the number of posts per plate in a filter may be the same, it may vary in some embodiments. For example, FIG. 7 shows a portion of a filter in which filter plate 60A has two radially extending post elements and filter plate 60B has four radially extending post elements. Generally, the plate geometries are symmetric to the center of the filter. For example, filter plates 60A and 60F are the same, filter plates 60B and 60E are the same, and filter plates 60C and 60D are the same.

Referring to FIG. 3, each tuning assembly 62 includes a metallic element 63 that is adjustable by a screw 65 or other adjusting element to a penetration depth into the associated segment.

The number of plates, their dimensions and the distance a–g between adjacent plates determine the amount of bandwidth and rejection of bandpass filter 48. By way of example, the distances a–g for a channel 22 (518–524 MHz) design vary in the range of about 9.4 inches to about 10.5 inches. The widths of the posts determine the amount of coupling between sections of transmission line 58. This coupling defines the filter response. Typically, the post size is symmetric with respect to the center of the filter. That is, posts at either end of filter 48 have identical dimensions, the second and n−1th posts have identical dimensions, and so on. The number of plates and the distance between adjacent plates provide a coarse tuning of the bandpass filter to the carrier or center frequency of the channel. The tuning assemblies 62 provide fine tuning.

The signal separator and bandpass filter of the present invention are useful to separate from a composite signal two or more signals with different carrier frequencies over a wide frequency band including rf carrier frequencies in the same band, such as the VHF or the UHF band. For example, the signal separator of the invention can be used to separate two UHF signals, such as channels 22 and 35, where channel 22 is an NTSC signal and channel 35 is a DTV signal.

The present invention having been thus described with particular reference to the preferred forms thereof, it will be obvious that various changes and modifications may be made therein without departing from the spirit and scope of the present invention as defined in the appended claims.

What is claimed is:

1. A bandpass filter comprising:

a coaxial transmission line having a hollow outer conductor and an inner conductor disposed within said outer conductor, wherein said transmission line includes a plurality of segments; and a plurality of electrically conductive elements disposed within said outer conductor and coupled mechanically and electrically to said outer conductor, wherein said electrically conductive elements are disposed transversely to a longitudinal axis of said outer conductor and wherein each of said electrically conductive elements includes a metallic annulus and a metallic post that extends radially of said annulus and that is coupled to said inner conductor, wherein the number of electrically conductive elements and the distance between adjacent ones of the electrically conductive elements are determinative of the response of the filter, wherein each of said plurality of electrically conductive elements is a plate, and wherein adjacent ones of said plurality of plates are disposed at a first and second end of each of said plurality of segments.

2. The bandpass filter of claim 1, further comprising a plurality of couplers, wherein each of said plurality of couplers is coupled to each of said plurality of segments and adjacent ones of said plurality of segments to one another, and wherein each of said couplers couples one of said plurality of plates to the outer conductors of said adjacent segments.

3. The bandpass filter of claim 2, wherein each of said plurality of couplers includes first and second flanges and wherein the first flange of each of said plurality of couplers is coupled to the first flange of the adjacent coupler and wherein the second flange of each of said plurality of couplers is coupled to the second flange of the adjacent coupler, connected to said first and second ends of said adjacent segments, respectively, and means for fastening adjacent said first and second flanges to one another.

4. The bandpass filter of claim 3, wherein at least one of said first and second flanges includes a well that mates with and holds an associated one of said plates.

5. The bandpass filter of claim 4, wherein each of said plates includes a plurality of metallic posts, each of said plurality of posts extending radially of said annulus.

6. The bandpass filter of claim 1, wherein each of said electrically conductive elements is a metal of the group that consists of copper, aluminum and an alloy of either.

7. A filter assembly that splits a composite signal having a first rf carrier frequency and a second rf carrier frequency, said filter assembly comprising:

an input that receives said composite signal;

first and second bandpass filters connected to said input, said first and second bandpass filters being tuned to pass said first and second carrier frequencies, respectively, and to reject said second and first carrier frequencies, respectively;

wherein said first bandpass filter comprises:

a coaxial transmission line having a hollow outer conductor and an inner conductor disposed within said outer conductor, wherein said transmission line includes a plurality of segments; and a plurality of electrically conductive elements disposed within said outer conductor and coupled mechanically and electrically to said outer conductor, wherein said electrically conductive elements are disposed transversely to a longitudinal axis of said outer conductor and wherein each of said electrically conductive elements includes a metallic annulus and a metallic post that extends radially of said annulus and that is coupled to said inner conductor, wherein the number of electrically conductive elements and the distance between adjacent ones of the electrically conductive elements are determinative of the response of the filter, wherein each of said plurality of electrically conductive elements is a plate, and wherein adjacent ones of said plurality of plates are disposed at a first and second end of each of said plurality of segments.

8. The filter assembly of claim 7, further comprising a plurality of couplers, wherein each of said plurality of couplers is coupled to each of said plurality of segments and adjacent ones of said plurality of segments to one another, and wherein each of said couplers couples one of said plurality of plates to the outer conductors of said adjacent segments.

9. The filter assembly of claim 8, wherein each of said plurality of couplers includes first and second flanges and wherein the first flange of each of said plurality of couplers is coupled to the first flange of the adjacent coupler and wherein the second flange of each of said plurality of couplers is coupled to the second flange of the adjacent coupler, connected to said first and second ends of said adjacent segments, respectively, and means for fastening adjacent said first and second flanges to one another.

10. The filter assembly of claim 9, wherein at least one of said first and second flanges includes a well that mates with and holds an associated one of said plates.

11. The filter assembly of claim 10, wherein each of said plates includes a plurality of metallic posts, each of said plurality of posts extending radially of said annulus.

12. The filter assembly of claim 7, wherein each of said electrically conductive elements is a metal of the group that consists of copper, aluminum and an alloy of either.

13. A filter assembly that splits a composite signal having a first rf carrier frequency and a second rf carrier frequency, said filter assembly comprising:

an input that receives said composite signal;

first and second bandpass filters connected to said input, said first and second bandpass filters being tuned to pass said first and second carrier frequencies, respectively, and to reject said second and first carrier frequencies, respectively;

wherein said first bandpass filter comprises:

a coaxial transmission line having a hollow outer conductor and an inner conductor disposed within said outer conductor, wherein said transmission line includes a plurality of segments; and a plurality of electrically conductive elements disposed within said outer conductor and coupled mechanically and electrically to said outer conductor, wherein said electrically conductive elements are disposed transversely to a longitudinal axis of said outer conductor and wherein each of said electrically conductive elements includes a metallic annulus and a metallic post that extends radially of said annulus and that is coupled to said inner conductor, wherein the number of electrically conductive elements and the distance between adjacent ones of the electrically conductive elements are determinative of the response of the filter, wherein each of said electrically conductive elements is a metal of the group that consists of copper, aluminum and an alloy of either, wherein each of said plurality of electrically conductive elements is a plate, wherein adjacent ones of said plurality of plates are disposed at a first and second end of each of said plurality of segments, and wherein said second bandpass filter is substantially identical to said first bandpass filter except that the number of plates and segments and the distance between said plates thereof are selected so that said second bandpass filter has a bandwidth centered about said second carrier frequency.

* * * * *